US010314400B2

(12) United States Patent
Colonello et al.

(10) Patent No.: US 10,314,400 B2
(45) Date of Patent: Jun. 11, 2019

(54) ROTATABLE SEAT CRADLE

(71) Applicant: Simtec, LLC, Beverly Hills, CA (US)

(72) Inventors: Dennis Colonello, Los Angeles, CA (US); James E. Grove, Marina Del Rey, CA (US)

(73) Assignee: SIMTEC, LLC, Beverly Hills, CA (US)

( * ) Notice: Subject to any disclaimer, the term of this patent is extended or adjusted under 35 U.S.C. 154(b) by 139 days.

(21) Appl. No.: 14/747,040

(22) Filed: Jun. 23, 2015

(65) Prior Publication Data

US 2016/0374471 A1 Dec. 29, 2016

(51) Int. Cl.

| | |
|---|---|
| ***A47C 1/122*** | (2006.01) |
| ***A47C 3/025*** | (2006.01) |
| ***A47C 3/12*** | (2006.01) |
| ***A47C 7/46*** | (2006.01) |

(52) U.S. Cl.

CPC ..... *A47C 1/122* (2013.01); *A47C 3/0255* (2013.01); *A47C 3/12* (2013.01); *A47C 7/46* (2013.01)

(58) Field of Classification Search

None

See application file for complete search history.

(56) References Cited

U.S. PATENT DOCUMENTS 3,711,152 A * 1/1973 Sirpak ..... A47C 1/0342 297/282
4,500,137 A 2/1985 Morehouse
4,545,613 A * 10/1985 Martel ..... B60N 2/2821 297/256.13
4,852,945 A 8/1989 Rowles et al.
5,024,485 A * 6/1991 Berg ..... A47C 3/025 297/270.1
5,333,934 A * 8/1994 Knoblock ..... A47C 1/03255 297/452.15
5,368,359 A * 11/1994 Eakin ..... A61H 23/0236 297/184.14
5,383,709 A * 1/1995 Chaney ..... A61G 5/14 297/302.2
5,509,719 A * 4/1996 Cone, II ..... A47C 3/04 248/188.5

(Continued)

FOREIGN PATENT DOCUMENTS

DE 9303674 5/1993

*Primary Examiner* — David E Allred

(74) *Attorney, Agent, or Firm* — Squire Patton Boggs US LLP

(57) ABSTRACT

A rotatable seat cradle including a lumbar supporting back, a thigh supporting front, an intermediate pelvic support bucket located between the back and the front, and an upwardly sloping transition wall that extends continuously and co-extensively between the pelvic support bucket and the thigh supporting front. The seat cradle is pivotally coupled to a stand or to a yoke connected to a chair base. The thigh supporting front of the seat cradle lies above the pelvic support bucket and cantilevers outwardly from the upwardly sloping transition wall. A seated user shifting his weight towards the front of the seat cradle pushes his legs against the thigh supporting front to generate a rotational force thereagainst for causing a corresponding rotation of the seat cradle relative to the stand or the yoke to which the seat cradle is pivotally coupled.

18 Claims, 8 Drawing Sheets

(56) References Cited

U.S. PATENT DOCUMENTS 5,516,134 A * 5/1996 Crawford ..... A47C 3/12 280/288.1
5,540,481 A * 7/1996 Roossien ..... A47C 3/12 297/300.4
5,984,409 A * 11/1999 Eakin ..... A47C 7/56 297/281
6,050,642 A * 4/2000 Erb ..... A47C 1/032 297/259.2
6,168,233 B1 * 1/2001 Markus ..... A47C 3/025 297/302.3
6,325,455 B1 * 12/2001 Chung ..... A47C 1/02 297/282
6,394,547 B1 5/2002 Vik
6,974,188 B2 * 12/2005 Turner ..... A47C 7/48 297/270.2
7,677,663 B1 * 3/2010 Charles ..... B60N 2/14 114/363
7,850,238 B2 * 12/2010 Erb ..... A47C 1/024 297/321
8,157,327 B2 * 4/2012 Tomasi ..... A47D 1/002 297/148
8,668,273 B2 * 3/2014 Wang ..... A47D 1/002 297/173
8,671,482 B2 3/2014 Willingham
8,926,017 B2 * 1/2015 Grove ..... A47C 3/0252 297/284.1
8,979,201 B2 * 3/2015 Erb ..... A47C 1/024 297/321
2005/0059502 A1 * 3/2005 Greger ..... A47D 13/02 472/118
2007/0057562 A1 3/2007 Gregory et al.
2007/0222266 A1 * 9/2007 Lucci ..... A47C 1/121 297/331
2008/0303232 A1 * 12/2008 Chen ..... B62B 7/142 280/47.41
2010/0253122 A1 10/2010 Okimoto et al.
2010/0269352 A1 * 10/2010 Curtin ..... B26B 21/521 30/123.5
2014/0062153 A1 3/2014 Grove et al.
2015/0015042 A1 * 1/2015 Willingham ..... A47C 7/022 297/284.7

* cited by examiner

ROTATABLE SEAT CRADLE

BACKGROUND OF THE INVENTION

1. Field of the Invention

This invention relates to a posture-improving seat cradle that, in a preferred embodiment, is pivotally connected and rotatable relative to a stand connected to the ground or to a yoke connected to a chair base. The rotatable seat cradle is configured to unload a user's upper body weight from his pelvic sacroiliac joints while promoting a neutral spine sitting posture and inducing anterior pelvic tilt and lumbar lordosis so as to maximize the user's comfort and posture while seated.

2. Background Art

Back pain is an epidemic health problem suffered by a majority of individuals at some point in their lives. The American Academy of Pain Medicine estimates that back pain costs Americans billions of dollars yearly, with back pain second only to the common cold in office visits to the doctor. It has long been known that back pain is one of many side effects attributed to prolonged sitting posture. Neutral spine posture is considered by experts in the field of ergonomics to be the optimal sitting posture. Anatomically, neutral spine posture is defined as the optimum spinal curvature wherein the cervical and lumbar divisions of the spine are moderately convex anteriorly (lordosis) and the thoracic and sacral divisions of the spine are moderately convex posteriorly (kyphosis).

In an unaided and unconscious seated posture, the tendency is for the sitter's pelvis to rock posteriorly on the seat surface, secondary to the sacral kyphosis, thereby initiating a reflex alordosis of the lumbar spine. Alordosis of the lumbar spine induces reflex concomitant postural compensations of both the thoracic and cervical spine divisions potentially leading to upper back and neck pain. It is well documented that alordosis of the lumbar spine results in a shift of the body's center of gravity forward of the neutral postural gravity line, thereby adversely loading the lumbar spine disc structures and predisposing the sitter to lower back pain. Many working in the field of ergonomics agree that neutral spine posture is the optimum sitting posture. Many also agree that neutral spine posture is facilitated by promoting both anterior pelvic tilt and lumbar lordosis. Traction of the spine has long been generally accepted as an effective method for alleviating back pain. Traction of the spine unloads the soft and hard tissue structures of the spine thereby relieving these tissues from the compressive forces associated with prolonged sitting which may relieve the pain associated therewith.

As far as can be determined, a rotatable seat cradle is unknown having a leg support front portion inclined upwardly from a pelvic support intermediate portion and further including a lumbar spine support back portion such that a rotation of the seat cradle in response to a forward leaning sitter promotes dynamic anterior pelvic tilt and dynamic lumber lordosis while simultaneously unloading the sitter's upper body weight from his pelvis for effectively positioning of the sitter's back towards a neutral spine seated posture.

SUMMARY OF THE INVENTION

Disclosed herein is a seat cradle having a variety of seating applications as a stand-alone seat or as a seat that is pivotally coupled and rotatable relative to a stationary stand. The seat cradle is ideally manufactured as a one-piece shell molded from a plastic material. The seat cradle includes a lumbar supporting back against which a user rests his lower back, a curved downwardly sloping thigh supporting front against which the user rests his legs, and an intermediate deep pelvic support bucket located between the lumbar supporting back and the thigh supporting front within which the user's pelvis is received. A curved upwardly sloping transition wall extends continuously between the pelvic support bucket and the downwardly sloping thigh supporting front. The thigh supporting front of the cradle cantilevers outwardly to receive a rotational force thereagainst when the user shifts his weight to the front of the cradle. Accordingly, the forward leaning user causes a corresponding forward and clockwise rotation of the seat cradle at a pivot which is substantially axially aligned with the user's hips. Such rotation lifts and rotates the lumber supporting back and the pelvic support bucket of the seat cradle, whereby to dynamically and advantageously induce anterior tilting of the user's pelvis and position the user's back towards neutral spine posture at which to promote the user's comfort while seated.

In a first seating application, the rotatable seat cradle is pivotally coupled to and rotatable relative to a stand. The stand can be affixed to the ground, located on top of an elevated surface, or simply placed on the seat of a conventional chair. The stand has a pair of upright braces that are pivotally coupled at first ends thereof to support bushings at opposite sides of the seat cradle. A flat base is located at the opposite end of each upright base to be laid upon the support surface. The rotatable seat cradle is suspended by the stand above the support surface so that when the user shifts his weight, the seat cradle will rotate relative to the stand and the support surface on which the stand is laid.

In another seating application, the rotatable seat cradle is coupled to a yoke, and the yoke is connected to the base of a conventional chair in place of the usual chair seat. The yoke includes a U-shaped base running laterally below the bottom of the seat cradle and affixed to the seat plate of the chair base and a pair of upturned struts lying at opposite sides of the seat cradle. A coupling hole is formed through each of the upturned struts of the yoke. A cradle positioning stopper manufactured from an elastomeric material having a spring memory is received within each coupling hole to be surrounded and held in place by a cylindrical coupling sleeve attached to the outside of each strut of the yoke. The cradle positioning stoppers are mounted on respective pivot support bushings at opposite sides of the rotatable seat cradle, whereby the seat cradle is coupled to the yoke. A stationary position limiting key projects into the coupling hole formed in each of the upturned struts of the yoke so as to be located in a notch formed in each of the cradle position stoppers received within the coupling holes. When the user shifts his weight, the rotatable seat cradle correspondingly rotates relative to the yoke, and the cradle position stoppers mounted to opposite sides of the cradle will simultaneously rotate within respective coupling holes. The seat cradle rotates in a clockwise or a counter-clockwise direction until the cradle positioning stoppers which rotate with the cradle move into engagement with respective stationary position limiting keys that project into the notches formed in the stoppers.

DESCRIPTION OF THE PREFERRED EMBODIMENT

Figure 1:
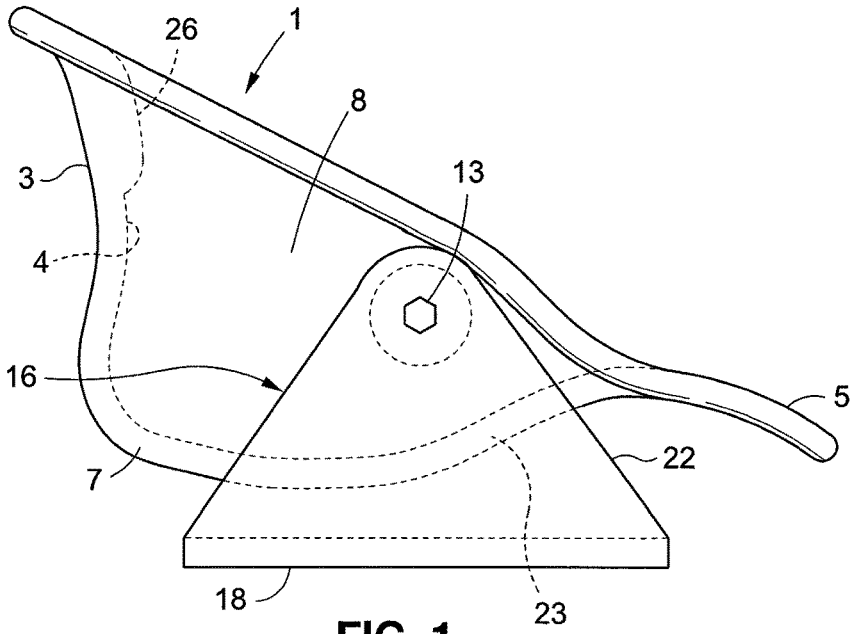
FIG. 1 is a side view of a rotatable seat cradle coupled to and rotatable relative to a stand in accordance with a first seating application.
Figure 2:
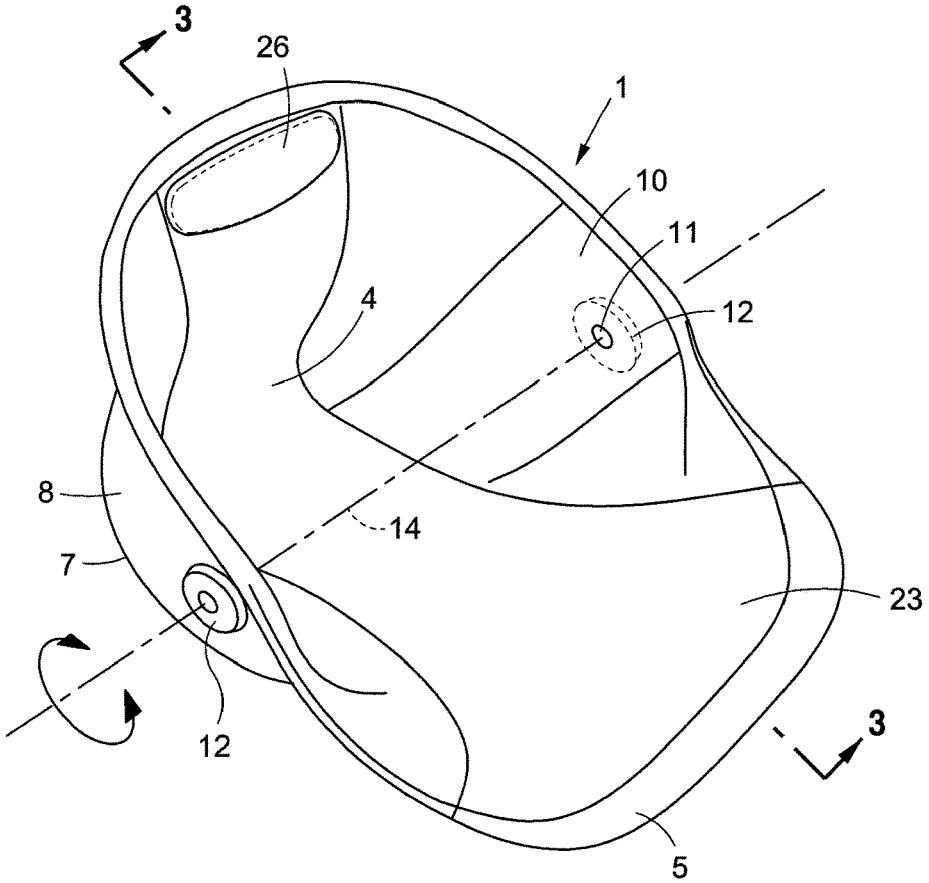
FIG. 2 is a perspective view of the rotatable seat cradle shown in FIG. 1 being rotatable around a pivot axis.

Referring initially to FIGS. 1-5 of the drawings, there is shown a first preferred embodiment for a simple, low cost rotatable seat cradle 1 which offers the advantages of this invention. The seat cradle 1 is ideally manufactured as a one-piece shell from conventional blow-molded or injection-molded plastic. The seat cradle 1 includes a generally upright lumbar supporting back 3 against which the back of a user seated in the cradle is received. The seat cradle 1 also includes a thigh supporting front 5 located at the forward leading edge of cradle 1 opposite the lumbar supporting back 3. The user's legs rest upon the thigh supporting front 5. Located between the lumbar-supporting back 3 and the thigh-support front 5 of the seat cradle 1 is a deep, generally U-shaped pelvic support bucket 7 within which the seated user's pelvis is received. The user's lower spine is engaged by a portion 4 of the lumbar-supporting back 3 that is molded into the seat cradle 1 so as to project inwardly and forwardly towards the thigh-supporting front 5 so as to lie ahead of an adjacent rearwardly projecting portion of the pelvic support bucket 7 (best shown in FIG. 5).

Figure 3:
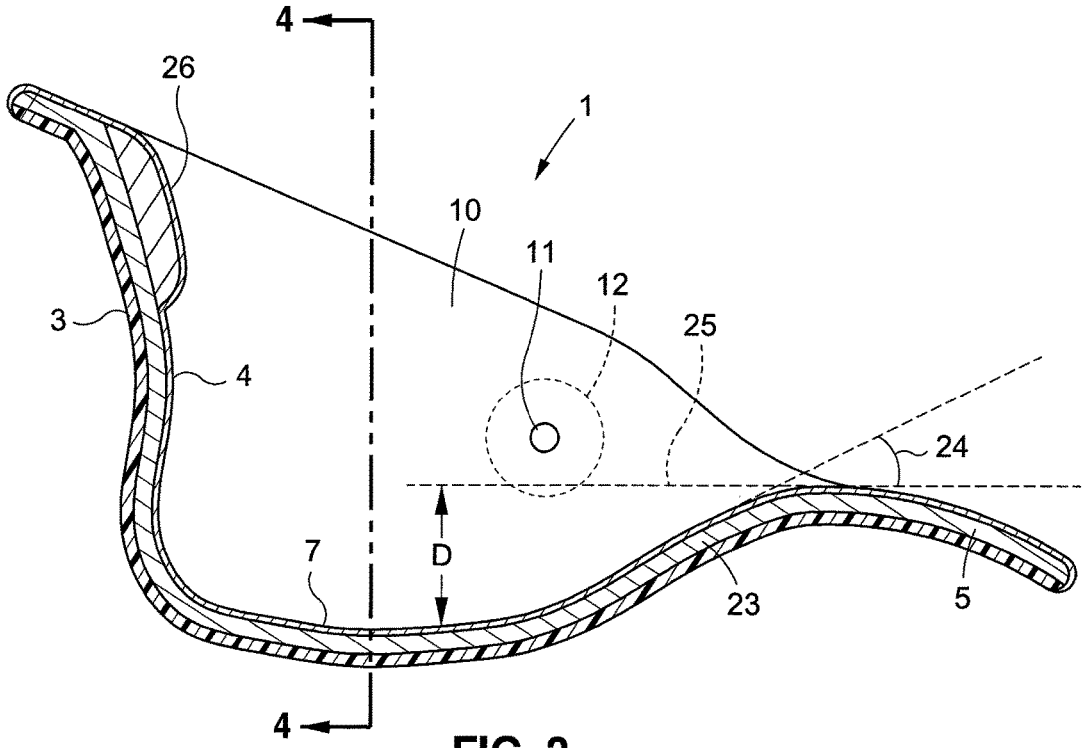
FIG. 3 is a cross-section of the rotatable seat cradle taken along lines 3-3 of FIG. 2.
Figure 4:
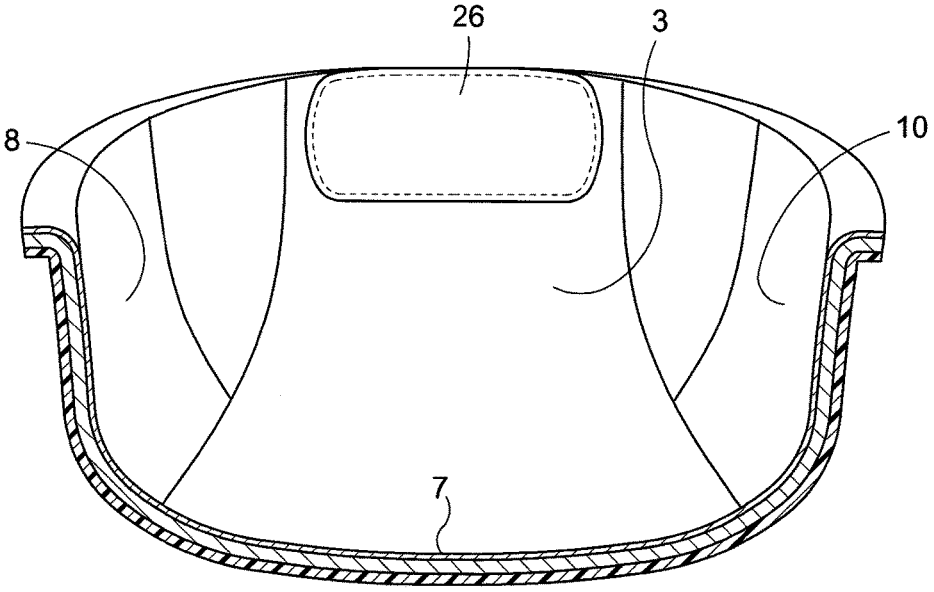
FIG. 4 is cross-section of the rotatable seat cradle taken along lines 4-4 of FIG. 3.

The seat cradle 1 has a pair of opposing side walls 8 and 10 that are co-extensive to and rise vertically above the pelvic support bucket 7. A pair of axially-aligned holes (only one of which 11 being shown in FIGS. 2 and 3) are formed through the side walls 8 and 10 of seat cradle 1. A pivot support bushing 12 is affixed to the outside of each of the side walls 8 and 10 so as to surround and reinforce the axially-aligned holes 11 formed therethrough. The holes 11 and pivot support bushings 12 at the opposite side walls 8 and 10 of the rotatable seat cradle 1 are positioned to receive respective pivots (e.g., shoulder bolts, only one of which 13 being shown in FIG. 1) therewithin by which to establish a linear pivot axis 14 (best shown in FIG. 2) around which the seat cradle 1 can rotate in response to a rotational force applied thereto. The linear pivot axis 14 runs laterally across the seat cradle 1 between the side walls 8 and 10 thereof in substantial axial alignment with the hip joints of the user so that the cradle 1 will be equally weighted on opposite sides of the pivot axis and thereby balanced in a neutral position as shown in FIGS. 1 and 3 when the cradle is empty.

Figure 5:
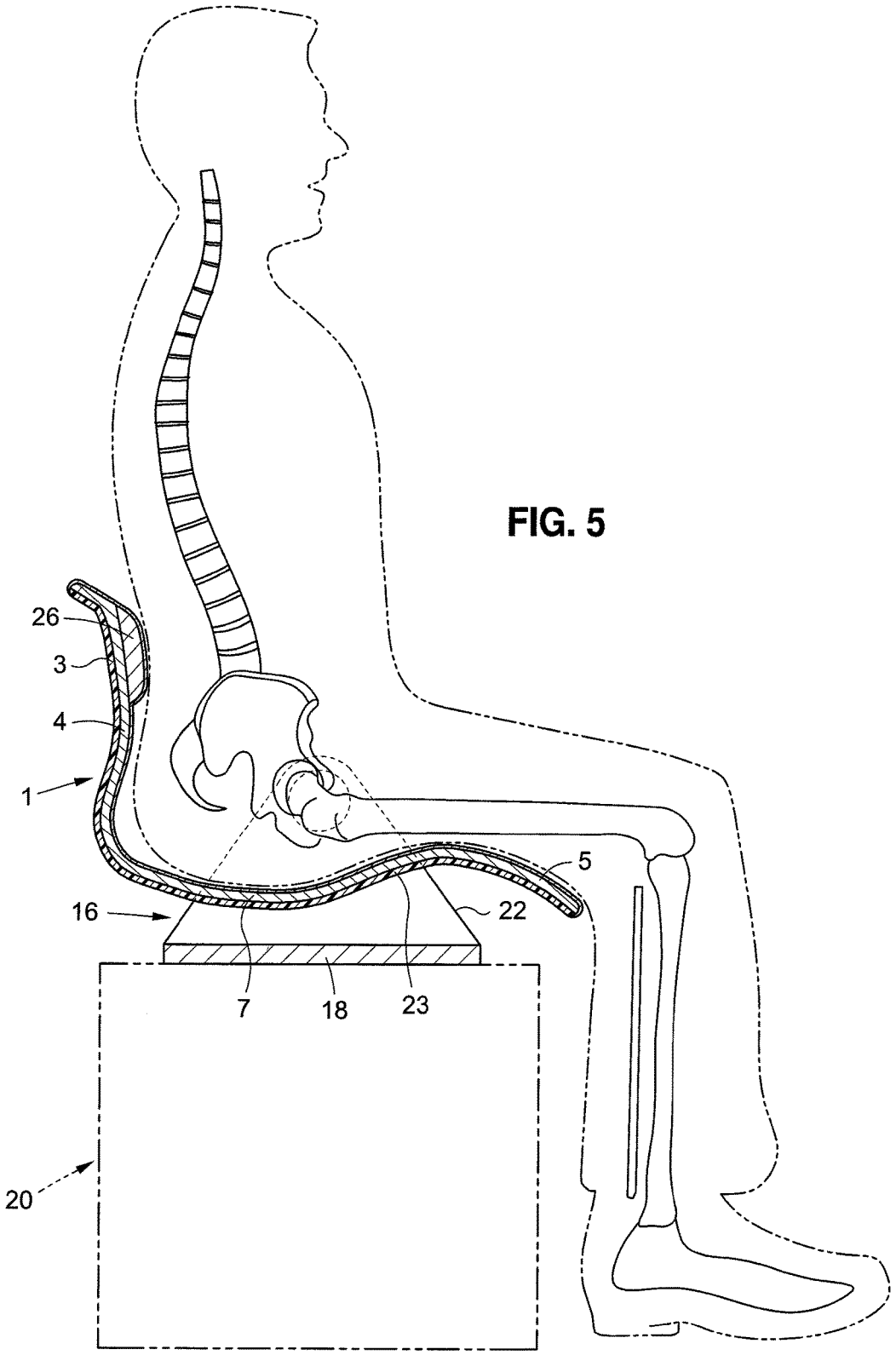
FIG. 5 is a cross-section of the rotatable seat cradle and the stand of FIG. 1 lying atop an elevated support surface.

As is best shown in FIGS. 1 and 5, the rotatable seat cradle 1 is pivotably coupled to a stand 16. The particular stand 16 to which the seat cradle is coupled is not to be considered a limitation of this invention. By way of example only, the stand 16 of FIGS. 1 and 5 includes a flat base 18 that is either laid on or affixed to any suitable flat surface (represented diagramatically by reference numeral 20 of FIG. 5). The shape and elevation (if any) of the surface 20 upon which the rotatable seat cradle 1 is laid are matters of choice depending upon the application of the seat cradle.

A pair of upright braces (only one of which 22 being shown in FIGS. 1 and 5) project vertically upward from respective opposite ends of the flat base 18 of stand 16. Each upright brace 22 holds one of the aforementioned pivots (e.g., shoulder bolts 13) that is surrounded and supported by one of the outside pivot support bushings 12 at a corresponding one of the side walls 8 and 10 of seat cradle 1. In this manner, the rotatable seat cradle 1 is suspended by the stand 16 above the flat base 18 thereof so as to be capable of rotating back and forth around the pivot axis 14 (of FIG. 2) relative to the stand 16 and the surface (e.g., 20) upon which the stand is laid or affixed.

As an important detail of the rotatable seat cradle 1, in its neutral position shown in FIGS. 1, 3 and 5, the bottom of the pelvic support bucket 7 which is the closest to the support surface lies below the top of the thigh supporting front 5. More particularly, an upwardly sloping transition wall 23 extends continuously and co-extensively between the pelvic support bucket 7 and the thigh supporting front 5. The transition point at which the upwardly sloping transition wall 23 joins the thigh supporting front 5 is spaced above the bottom of the pelvic support bucket 7 by a distance (designated D in FIG. 3) which is dependent upon the size of the expected user. That is, the distance D of the seat cradle 1 will be shorter for small children and larger for big and/or tall individuals.

What is more, the slope of the upwardly sloping transition wall 23 forms an ideal angle (designated 24 in FIG. 3) of equal to or less than 45 degrees with respect to a horizontal reference line 25 through the aforementioned transition point at which the upwardly sloping transition wall 23 joins the thigh supporting front 5. Thus, the thigh supporting front 5 of cradle 1 cantilevers outwardly from the upwardly sloping transition wall 23 at the forward leading edge of the cradle. Accordingly, a forward movement of the user seated in the rotatable cradle 1 results in the legs of the user applying a corresponding rotational pushing force in a clockwise direction against the cantilevered thigh supporting front 5, whereby the cradle will rotate around the pivot axis 14 (of FIG. 2) relative to the stand 16 to which the cradle is pivotally coupled.

Referring specifically to FIG. 5 of the drawings, a user is shown seated within the rotatable seat cradle 1 with his back lying against the lumber support back 3, his legs resting upon the cantilevered thigh supporting front 5, and his pelvis received by the pelvic support bucket 7. The seat cradle 1 is in its neutral, weight balanced position ready to rotate in the clockwise direction should the user shift his weight forward and thereby apply the aforementioned pushing force against the thigh supporting front 5 as was just explained.

An optional posture correcting pad 26 extends inwardly from the lumbar supporting back 3 of the seat cradle 1 to engage the user's lower back and urge the user's spine into an erect posture. In this same regard, when the user shifts his weight forward in seat cradle 1 towards the thigh supporting front 5, the corresponding clockwise rotation of the seat cradle 1 lifts the user's lumbar and pelvis upwardly and forwardly so as to dynamically induce lumbar lordosis and anterior pelvic tilt. By virtue of the foregoing, the user's posture within cradle 1 is advantageously positioned towards a neutral spine posture. The rotation of the seat cradle 1 nudges the forwardly projecting portion 4 of the lumbar support back 3 into the user's lower back to provide an upward and forward traction force to the user's lumbar spine in a direction away from the pelvis in order to substantially unload the user's body weight from his seated pelvis. In the alternative, the forward projecting portion 4 of the lumbar support back 3 can be made flat and eliminated, and the posture correcting pad 26 can be sized and positioned to protrude towards the thigh supporting front 5 for receipt in the user's lower back. In either case, the rotatable seat cradle 1 herein disclosed is adapted to improve both the posture and comfort of the seated user.

Figure 6:
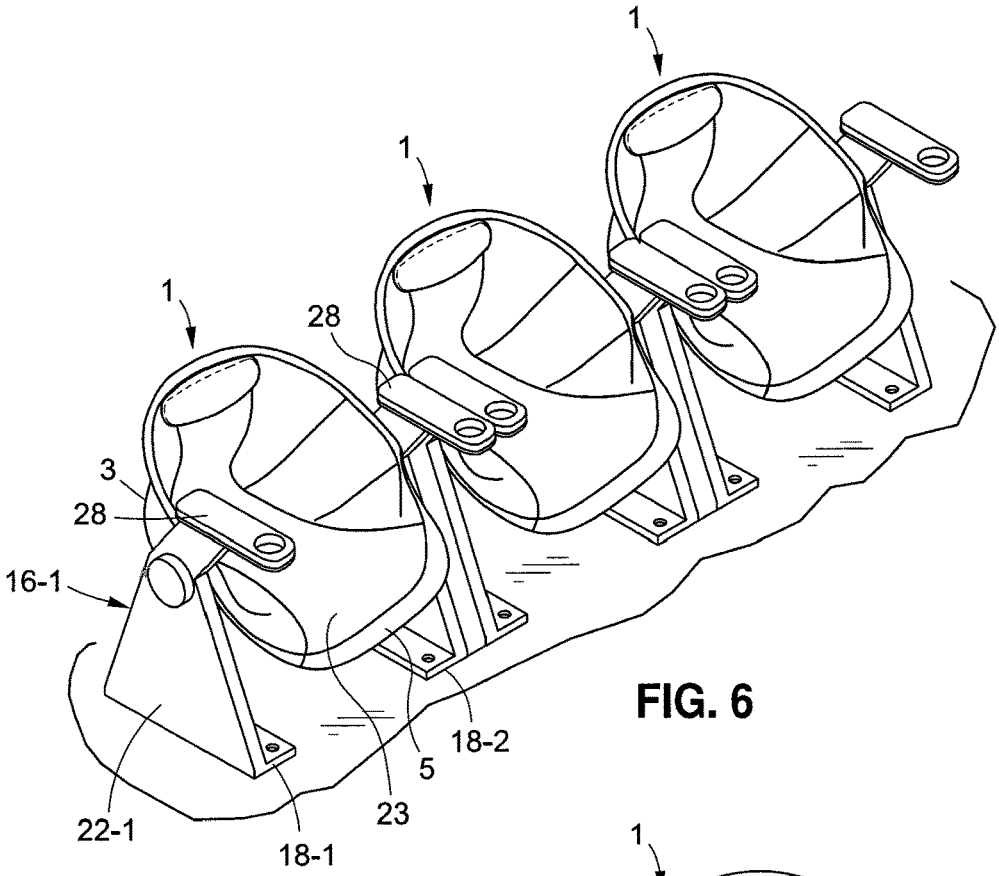
FIG. 6 shows a plurality of rotatable seat cradles located at a neutral seating position relative to a corresponding plurality of stands to which the seat cradles are coupled in accordance with a second seating application.
Figure 7:
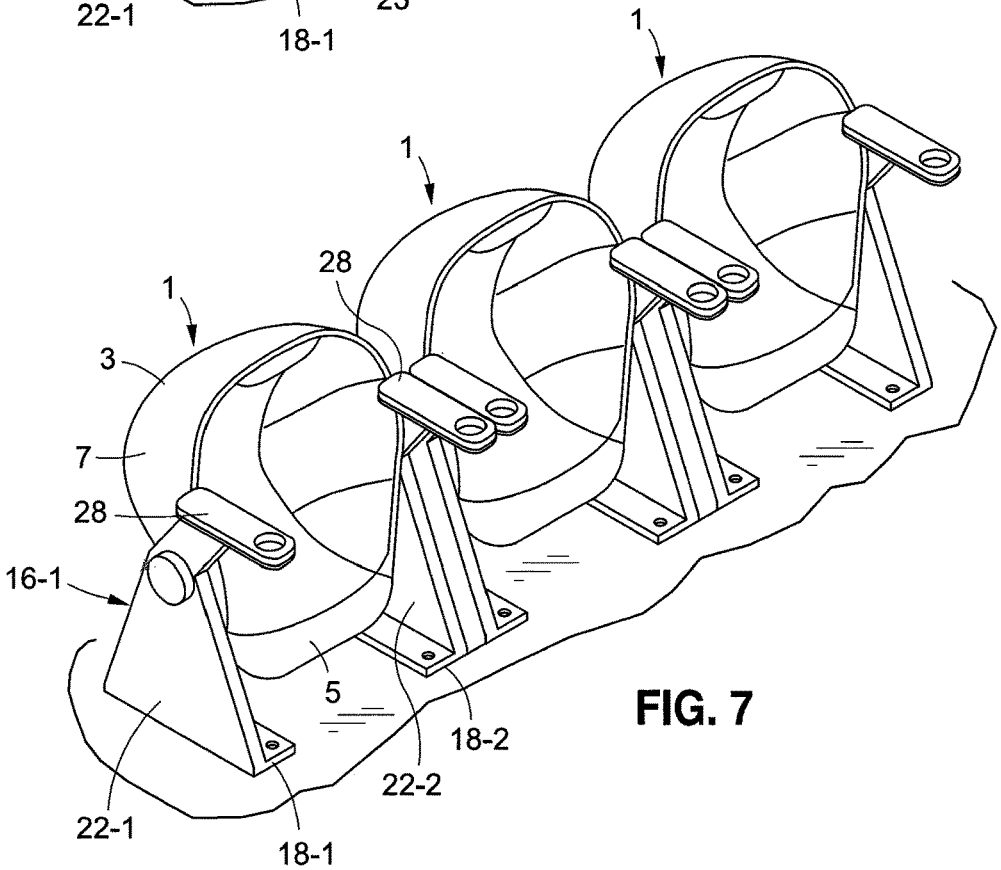
FIG. 7 shows the plurality of rotatable seat cradles of FIG. 6 rotated relative to the stands to a stowed position.

FIGS. 6 and 7 of the drawings show one example of a seating application for the rotatable seat cradle 1 that has been described while referring previously to FIGS. 1-5. In FIGS. 6 and 7, the seat cradle 1 is combined with a plurality of identical seat cradles aligned side-by-side one another to create a comfortable outdoor or indoor group seating arrangement for a corresponding number of occupants at a stadium, theater, airport waiting room, or the like. FIG. 6 shows each of the plurality of seat cradles 1 in its neutral, weight balanced position ready for occupancy. FIG. 7 shows the seat cradles 1 rotated around their pivot axes 14 (of FIG. 2) in a downward clockwise direction to a compact stowed position when the seat cradles are unoccupied. Of course, different ones of the plurality of rotatable seat cradles 1 can be selectively rotated to the neutral and the stowed positions of FIGS. 6 and 7 depending upon the number of occupants.

In the example shown in FIGS. 6 and 7, each seat cradle 1 is pivotally coupled to and suspended above the ground by a pair of stands 16-1 and 16-2 which are held in spaced facing alignment like those illustrated in FIGS. 1 and 5 so that a corresponding pair of vertically-upright braces 22-1 and 22-2 are located at opposite sides of the cradle. Flat bases 18-1 and 18-2 extend horizontally from respective ones of the pair of braces 22-1 and 22-2 of the stands 16-1 and 16-2 to be affixed to the ground. Thus, it may be appreciated that the elevated surface 20 shown in FIG. 5 upon which the seat cradle 1 is laid is now eliminated. An optional pair of arms 28 are attached to respective ones of the pair of upright braces 22-1 and 22-2 upon which the arms of one seated in the seat cradle may rest.

FIGS. 8-11 of the drawings illustrate another seating application for the rotatable seat cradle 1 that was previously described while referring to FIGS. 1-5. Identical reference numerals are used to designate identical features of the seat cradle 1 shown in FIGS. 1-5 and FIGS. 8-11. In its simplest application, the seat cradle 1 need not be pivotally coupled to a stand like that shown in FIGS. 1, 6 and 7. In this case, the seat cradle 1 may simply be placed upon and removed from a conventional chair such as, for example, that designated 30 in FIG. 11. Thus, the lumbar supporting back 3 of the seat cradle 1 lies adjacent the back 32 of the chair 30, and the thigh supporting front 5 of cradle 1 rests on the front of the chair seat 34. The pelvic support bucket 7 of the seat cradle 1 is shown lying against both the bottom of the chair back 32 and the rear of the chair seat 34. One seated and shifting his weight in the seat cradle 1 that has been placed on the chair 30 of FIG. 11 will advantageously receive the posture improving benefits described above which are not always available while sitting and rocking in the chair alone.

Figure 8:
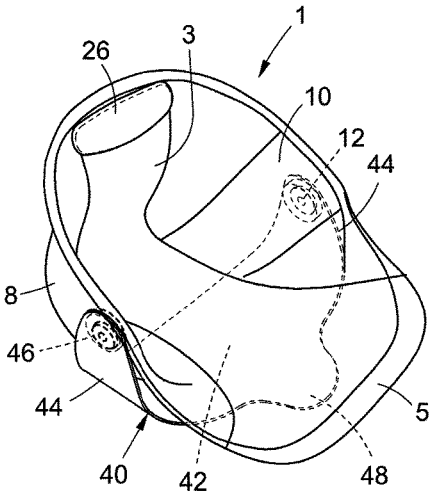
FIGS. 8 and 9 show the rotatable seat cradle of FIG. 1 pivotally coupled to and rotatable relative to a yoke in accordance with a different seating application.
Figure 9:
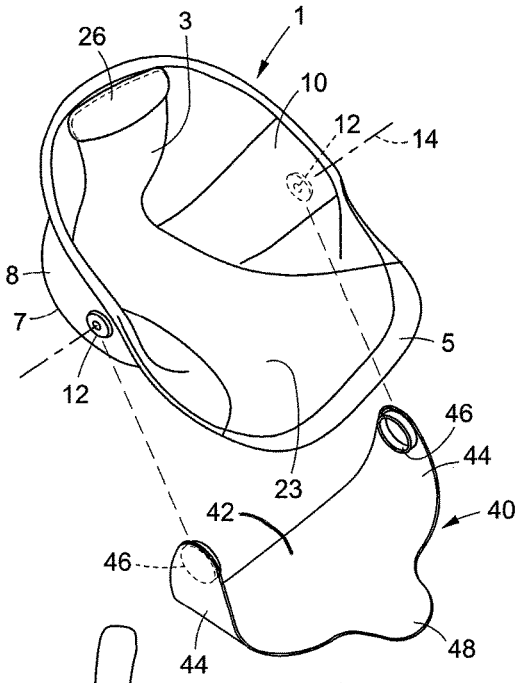
Figure 10:
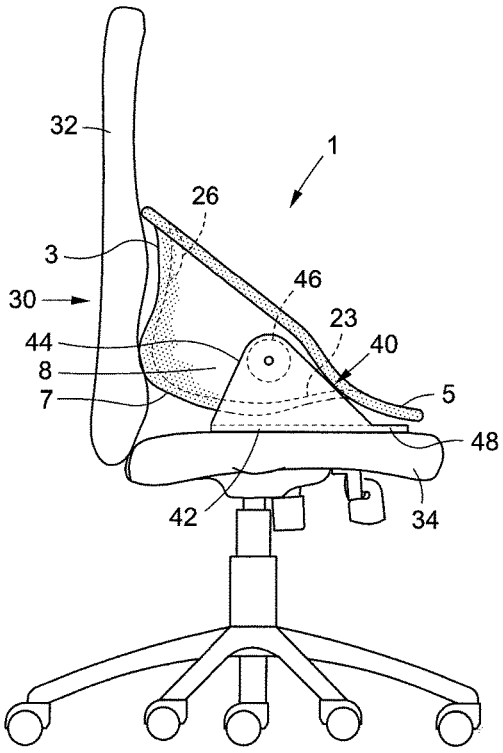
FIG. 10 shows the rotatable seat cradle and yoke of FIGS. 8 and 9 laid upon the seat of a conventional chair.
Figure 11:
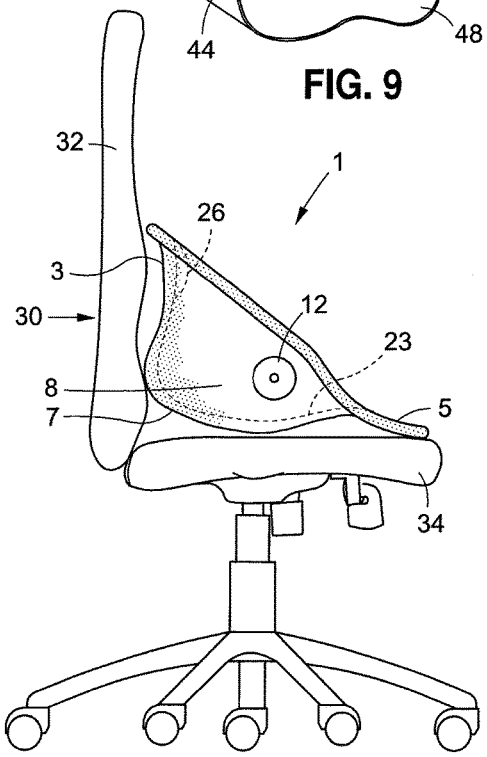
FIG. 11 shows the rotatable seat cradle of FIG. 1 laid upon the seat of a conventional chair in accordance with another seating application.
Figure 12:
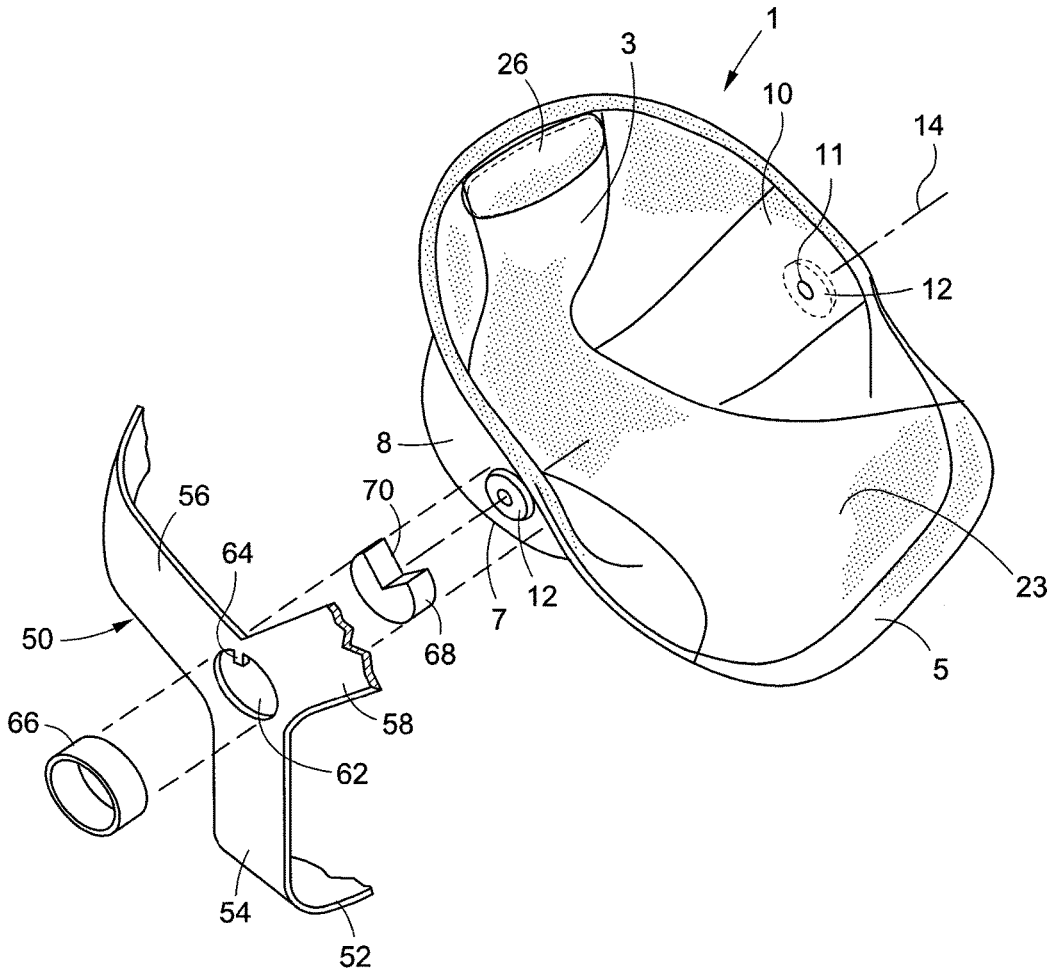
FIG. 12 is an exploded view showing the rotatable seat cradle of FIG. 1 being coupled to and rotatable relative to a yoke in accordance with yet another seating application.

Rather than being pivotally coupled to the stand 16 shown in FIGS. 1, 6 and 7, the rotatable seat cradle 1 can be seated on and removed from the chair 30 while coupled to a yoke 40 as shown in FIGS. 8, 9 and 10. The yoke 40 is preferably manufactured from a flexible plastic and includes a relatively flat base 42 and a pair of upturned side walls 44 lying in spaced opposing alignment with one another and having a spring memory. A pair of cylindrical couplers 46 face inwardly towards one another from the upturned side walls 44. The yoke 40 includes a frontal nose 48 that projects outwardly from the base 42 to lend support and stability to the base when the yoke is seated on the chair 30 as shown in FIG. 10.

The rotatable seat cradle 1 is pivotally and detachably coupled to the yoke 40 as shown in FIG. 8 by first bending the flexible side walls 44 of the yoke 40 outwardly and then locating the cylindrical couplers 46 thereof in surrounding engagement with respective ones of the pivot support bushings 12 (best shown in FIG. 9) which project from the side walls 8 and 10 of the seat cradle. The combination of the seat cradle 1 and the yoke 40 is placed on the seat 34 of the chair 30 such that the flat base 42 and the frontal nose 48 extending therefrom lie flush against the seat, and (as in the case of the seating arrangement shown in FIG. 11) the lumbar supporting back 3 of cradle 1 lies adjacent the chair back 32. When the user shifts his weight forward and back in the seat cradle 1, the seat cradle will rotate around its pivot axis (designated 14 in FIG. 9) relative to the yoke 40 to impart a corresponding force to the chair 30. However, the user is advantageously provided with the posture improving benefit offered by the rotatable seat cradle 1 as described above which is not always available from the chair alone.

Figure 13:
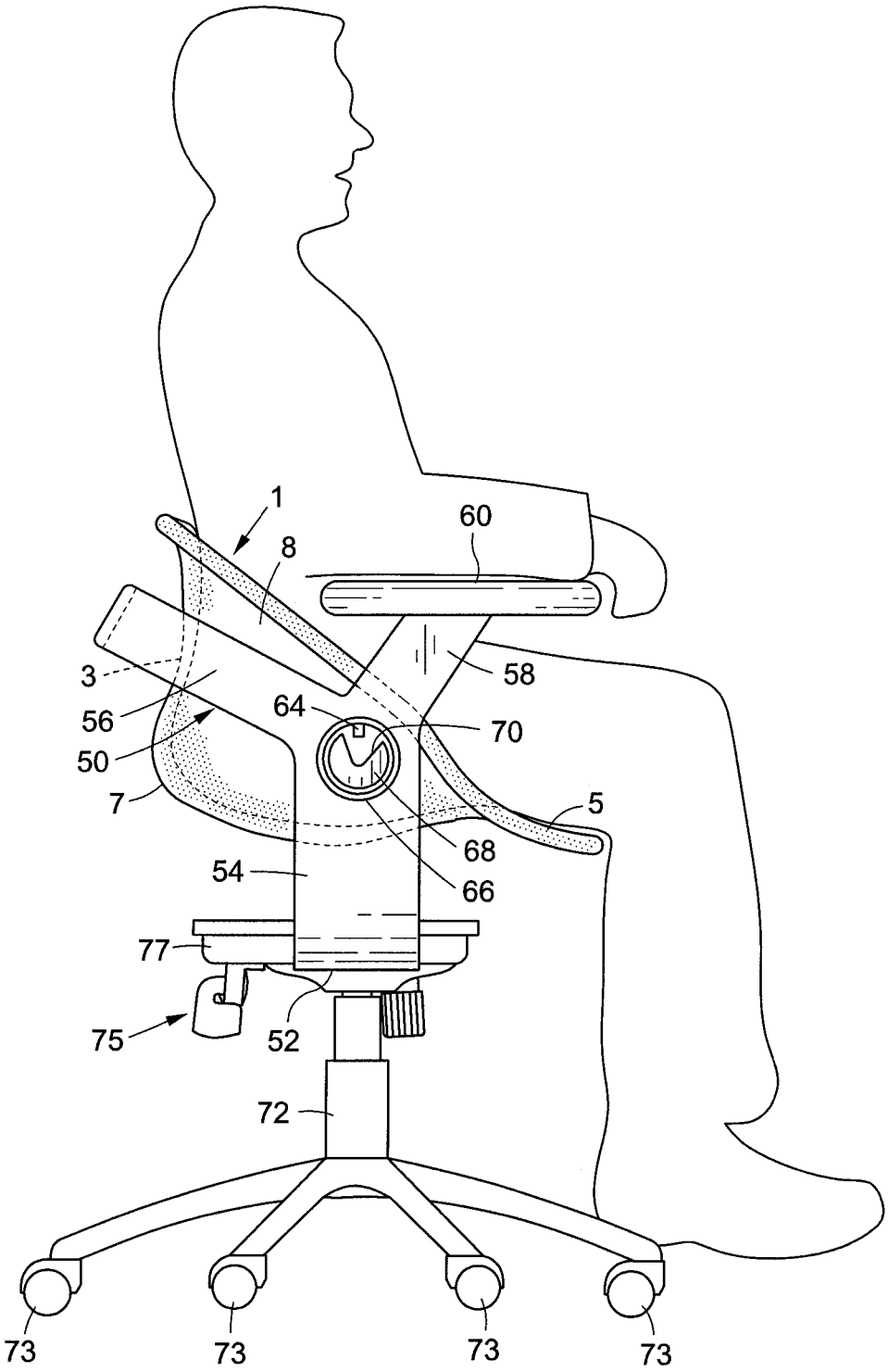
FIG. 13 shows the rotatable seat cradle pivotally coupled to the yoke of FIG. 12 and the yoke connected to the base of a conventional chair in place of the usual seat.

Turning now to FIGS. 12-17 of the drawings, the rotatable seat cradle 1 herein disclosed is shown in another seating application while being attached to a different chair (designated 75 and best shown in FIG. 13). In this case, the seat cradle 1 is coupled to and rotatable relative to a yoke 50, and the yoke 50 is affixed to the chair 75. Once again, identical reference numerals have been used to designate identical features of the seat cradle 1 illustrated in FIGS. 12-17. As will now be disclosed, the seat cradle 1 is attached to the existing base 72 of the chair 75 by means of the yoke 50 so as to replace the usual seat of the chair.

The yoke 50 includes a U-shaped base 52 lying at the bottom thereof and a pair of upturned vertically-extending struts 54 arranged in spaced facing alignment with one another. Co-extensively connected to and extending in a first direction from each upturned strut 54 at each side of the yoke 50 is an outstretched cradle support arm 56. Co-extensively connected to and extending in a second direction from each strut 54 is an arm pad support brace 58. The co-extensively-connected cradle support arm 56 and arm pad supporting brace 58 extend from each of the upturned struts 54 of yoke 50 in the first and second directions to form an angle therebetween of about 90 degrees.

In the assembled chair configuration of FIGS. 13-17 with the rotatable seat cradle 1 coupled to the yoke 50, the U-shaped base 52 lying at the bottom of yoke 50 runs underneath and laterally across the seat cradle to be connected to a plate 77 which is supported by the base 72 of the chair 75 at which the usual chair seat would have been connected had the chair seat not been replaced by the rotatable seat cradle 1 of this invention. The struts 54 which stand vertically upward from the base 52 run along respective side walls 8 and 10 of the seat cradle 1. The outstretched cradle supporting arms 56 which extend in the first direction from struts 54 are co-extensively and continuously connected to one another behind the lumbar supporting back 3 at the rear of seat cradle 1. Arm pads 60 against which the user can rest his arms while seated in cradle 1 are carried by the arm pad support braces 58 which extend from the struts 54 in the second direction.

A coupling hole 62 (best shown in FIG. 12) is formed through opposite sides of the yoke 50 at the intersection of the upturned struts 54 with the cradle supporting arms 56 and the arm pad supporting braces 58. A short stationary position limiting key 64 projects radially into each coupling hole 62 from a strut 54. A cylindrical coupling sleeve 66 (also best shown in FIG. 12) is attached (e.g., welded) to the outside of each upturned strut 54 of the yoke 50 so as to surround the coupling hole 62 formed therethrough.

A cradle position stopper (e.g., grommet) 68 having a notch 70 formed therein is dimensioned to be positioned through each coupling hole 62 for receipt in surrounding engagement and support by a cylindrical coupling sleeve 66. With the stopper 68 located within the coupling hole 62 and retained by sleeve 66, the stationary position limiting key 64 is correspondingly located in the notch 70 formed in the stopper. The cradle position stopper 68 may be formed from an elastomeric material having a spring memory for an advantage that will soon be explained. As is best shown in FIGS. 14 and 15, the cradle position stoppers 68 carried by the upturned struts 54 of the yoke 50 are affixed (e.g., adhesively bonded or pinned) to respective ones of the pivot support bushings 12 that are located on the outside of the side walls 8 and 10 of the rotatable seat cradle 1, whereby the cradle 1 is coupled to the yoke 50.

FIG. 13 shows a user seated within the rotatable seat cradle 1, the seat cradle pivotally coupled to the yoke 50, and the yoke fixedly connected to the chair 75 as previously explained. As was also previously explained and way of example, the chair 75 shown in FIG. 13 has a conventional base 72 and a set of rollers 73. The chair also has the aforementioned seat plate 77. However, instead of a seat to support the weight of the user, the combination rotatable seat cradle 1 and yoke 50 is connected to the base 72 of chair 70 at seat plate 77.

Figure 14:
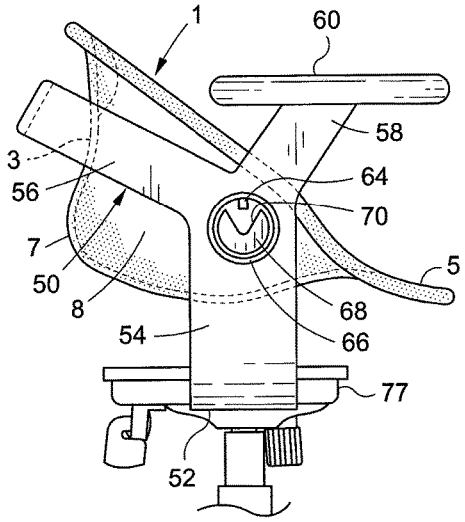
FIG. 14 is a side view of the rotatable seat cradle pivotally coupled to the yoke shown in FIG. 13 and rotated to a neutral seating position relative to the yoke.
Figure 15:
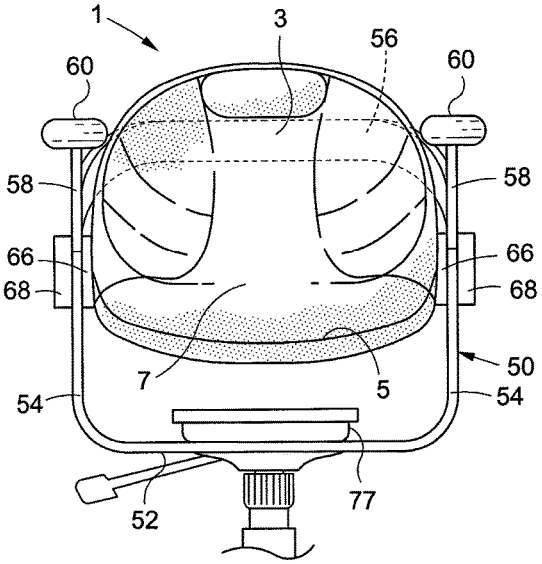
FIG. 15 is a top view of the rotatable seat cradle rotated to the neutral seating position as shown in FIG. 14.

FIGS. 13-15 show the seat cradle 1 located in the neutral (i.e., weight balanced) position. In this case, the stationary position limiting key 64 at each of the upturned struts 54 of the yoke 50 is located near the middle of the notch 70 formed in each cradle positioning stopper 68 adjacent opposite side walls 8 and 10 of cradle 1. It may be appreciated that the seat cradle 1 and the yoke 50 are coupled to one another so that the cradle position stoppers 68 which are connected to the cradle 1 at the pivot support bushings 12 thereof are rotatable within respective coupling holes 62 formed in the struts 54 of yoke 50. Thus, the seat cradle 1 is rotatable back and forth relative to the yoke 50 and the chair 70 to which the yoke 50 is fixedly connected.

Figure 16:
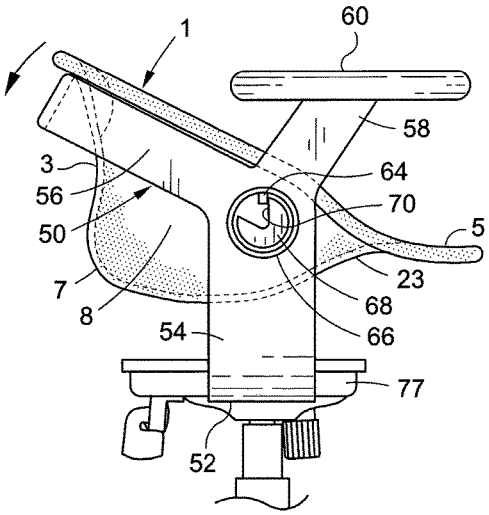
FIG. 16 is a side view of the rotatable seat cradle pivotally coupled to the yoke shown in FIG. 12 and rotated in a counter-clockwise direction relative to the yoke.

In this regard, FIG. 16 shows the seat cradle 1 rotated in a counter-clockwise direction with respect to the yoke 50 when the user shifts his weight backwards. In this case, the cradle position stoppers 68 located at opposite sides (only one of which 8 being visible) of the seat cradle 1 are rotated with the cradle 1 until each of the stationary position limiting keys (only one of which 64 being visible) engages one end of a corresponding stopper 68 at one end of the notch 70. At the same time, the lumbar supporting back 3 of seat cradle 1 engages the outstretched cradle supporting arms 56 of the yoke 50 which are located behind the back 3. Additional rotation of the seat cradle 1 in the counter-clockwise direction of FIG. 16 is blocked by the simultaneous engagement of the stationary position limiting keys 64 by respective ones of the cradle position stoppers 68 and the lumbar supporting back 3 by the cradle supporting arms 56.

Figure 17:
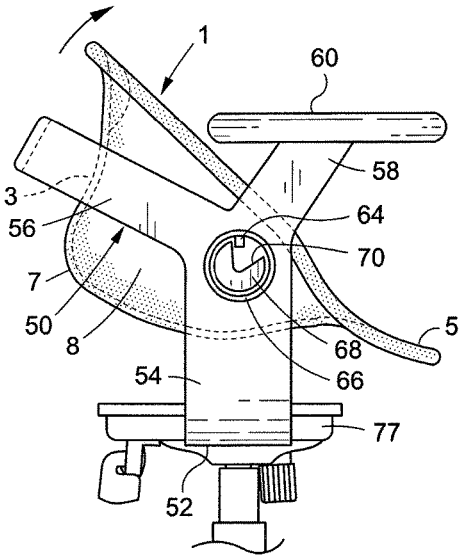
FIG. 17 is a side view of the rotatable seat cradle pivotally coupled to the yoke shown in FIG. 12 and rotated in a clockwise direction relative to the yoke.

FIG. 17 shows the seat cradle 1 rotated in a clockwise direction with respect to the yoke 50 when the user shifts his weight forwards. The cradle position stoppers 68 are now rotated with the seat cradle 1 until each stationary position limiting key 64 engages the opposite end of a corresponding cradle position stopper 68 at the opposite end of the notch 70 and the lumbar supporting back 3 of cradle 1 rotates away from the outstretched cradle supporting arms 56 of the yoke 50. Any additional rotation at the seat cradle 1 in the clockwise direction of FIG. 17 is blocked by the engagement of the stationary position limiting keys 64 by the cradle positioning stoppers 68.

As was indicated above, the cradle position stoppers 68 attached to opposite sides (e.g., 8) of the rotatable seat cradle 1 can be manufactured from an elastomeric material. In this case, when the cradle 1 is rotated in either of the counter-clockwise or clockwise directions of FIGS. 16 and 17, the stationary position limiting keys 64 are correspondingly pressed against one end of respective cradle positioning stoppers 68 which rotate into engagement therewith. Therefore, the stoppers 68 will be initially compressed and store energy. When the stoppers 68 expand, the spring memory characteristic thereof will urge the cradle 1 to rotate relative to the yoke 50 and towards the neutral position shown in FIGS. 13 and 14 when a user exits the cradle.

Regardless of its seating application, the rotatable seat cradle disclosed herein advantageously provides continuous support to the user's back while promoting seated neutral spine posture, dynamic anterior pelvic tilt, dynamic lumbar lordosis and a dynamic traction force applied to the user's lumbar spine so as to effectively unload the user's supper body weight from the user's seated pelvis, whereby to enable the user to experience maximum comfort especially at those times when he is leaning forward in the cradle.

What is claimed is:

1. A combination, including:

a chair base;

a one-piece rotatable seat cradle in which a user is to be seated, said one-piece seat cradle being held by said chair base and comprising:

a back at a first end thereof against which the seated user's back is received, a front at the opposite end upon which the user's legs are laid, an intermediate pelvic support bucket lying between said back and said front within which the user's pelvis is received, and a pair of sides spaced from and lying opposite one another, wherein, the one-piece rotatable seat cradle has a neutral position in which the back is substantially vertical, a bottom of the pelvic support bucket is substantially horizontal, and the front of said seat cradle lies above the bottom of said pelvic support bucket, and wherein the user leaning forward in the one-piece rotatable seat cradle causes the user's legs to apply a pushing force against said front by which to correspondingly cause said one-piece rotatable seat cradle to rotate in a forward direction and thereby unload the user's upper body weight from his pelvic sacroiliac joints so as to induce pelvic tilt and lumbar lordosis; and a yoke connected between said chair base and said one-piece rotatable seat cradle and comprising a pair of upright struts, wherein each of said pair of upright struts has a cradle support arm extending therefrom in a rearward direction so as to be joined to one another at a location behind and spaced from the back of said one-piece rotatable seat cradle at which to engage the back of said one-piece rotatable seat cradle and thereby prevent a further rotation of said one-piece rotatable seat cradle when the user leans back and said one-piece rotatable seat cradle rotates in said rearward direction towards said cradle support arms, wherein each of said pair of upright struts also has an arm pad supporting brace extending therefrom in an upward direction, wherein said yoke includes:

a coupling hole formed through each of said pair of upright struts, and a pair of cradle couplers, extending from each of the pair of sides of said one-piece rotatable seat cradle, each cradle coupler being located within a respective coupling hole of the coupling holes, such that the one-piece rotatable seat cradle is connected to the chair base by the pair of cradle couplers, and not otherwise connected to the chair base, such that the one-piece rotatable seat cradle is suspended above a portion of the chair base, wherein the cradle couplers cannot rotate with respect to the sides of the one-piece rotatable seat cradle, and wherein the cradle couplers rotate within said coupling holes and said one-piece rotatable seat cradle rotates freely in said forward and rearward directions relative to said yoke.

2. The combination recited in claim 1, wherein a portion of the back of said one-piece rotatable seat cradle projects inwardly towards the front of said one-piece rotatable seat cradle when the one-piece rotatable seat cradle is in the neutral position, such that the inwardly projecting portion of the back lies closer to the front than a portion of said pelvic support bucket and engages and presses against the lower spine of the seated user.

3. The combination recited in claim 1, wherein said rotatable seat cradle further comprises an upwardly sloping transition wall extending continuously and co-extensively between the pelvic support bucket and the front of said seat cradle, said front being cantilevered to said transition wall so as to be responsive to the pushing force applied thereto by the user's legs to cause said seat cradle to rotate relative to said yoke when the user leans forward in said seat cradle.

4. The combination recited in claim 3, wherein the cantilevered front of said rotatable seat cradle extends outwardly from the upwardly sloping transition wall, and wherein the upwardly sloping transition wall is joined to the cantilevered front at a transition point which is spaced above the bottom of said pelvic support bucket, the slope of said upwardly sloping transition wall making an angle of less than or equal to 45 degrees with a horizontal reference line through said transition point.

5. The combination recited in claim 1, wherein there is a coupling sleeve affixed to each of said pair of upright struts of said yoke to lie outside and surround the coupling hole formed therein, each cradle coupler being received within said coupling sleeve and extending therefrom for receipt within said coupling hole for rotation within said coupling hole when said rotatable seat cradle rotates.

6. The combination recited in claim 1, wherein there is a stationary position limiting key lying within the coupling hole formed in each of the pair of upwardly extending struts of said yoke, said position limiting key being engaged by said cradle coupler when said cradle coupler rotates within the coupling hole formed in a respective one of said pair of struts, whereby to limit the rotation of said rotatable seat cradle.

7. The combination recited in claim 6, wherein each cradle coupler has a notch formed therein, said stationary position limiting key lying within said notch so as to be engaged by said cradle coupler when said cradle coupler rotates within the coupling hole formed in a respective one of the pair of upright struts of said yoke, whereby to correspondingly limit the rotation of said rotatable seat cradle.

8. The combination recited in claim 6, wherein each cradle coupler is manufactured from an elastomeric material having a spring memory so that said cradle coupler is first compressed when said cradle coupler is rotated into engagement with said stationary position limiting key and then expands when the seated user exits said seat rotatable seat cradle, whereby said cradle coupler is urged to rotate away from said stationary position limiting key.

9. The combination recited in claim 1, wherein said yoke also comprises a yoke connecting base extending between said pair of upright struts and running underneath said rotatable seat cradle, said yoke connecting base being affixed to said chair base to thereby connect said yoke to said chair base, and wherein said chair base has a yoke mounting plate, the yoke connecting base of said yoke connected to said chair base at the yoke mounting plate thereof in substitution of a chair seat.

10. The combination recited in claim 9, wherein said pair of upright struts and said yoke connecting base which extends between said pair of upright struts are connected to one another such that said yoke has a U-shape.

11. The combination recited in claim 1, wherein the coupling holes formed through the pair of upright struts of said yoke and the cradle couplers located within respective ones of said coupling holes are located so as to be substantially axially aligned with one another, so that said cradle couplers and said seat cradle rotate together as said seat cradle rotates freely relative to said yoke in said forward and rearward directions when the user leans forward and back.

12. The combination recited in claim 1, wherein the coupling hole formed in each one of said pair of upright struts of said yoke to receive a cradle coupler therewithin is located at the intersection of the one of said pair of upright struts with the cradle support arm and an armrest which extend therefrom.

13. A combination, including:

a base;

a rotatable seat cradle in which a user is to be seated, said seat cradle being held by said base and comprising a back at a first end thereof against which the seated user's back is received, a front at the opposite end upon which the user's legs are laid, an intermediate pelvic support bucket lying between said back and said front within which the user's pelvis is received, and a pair of sides spaced from and lying opposite one another and extending between said back and said front, wherein, when the rotatable seat cradle is in a neutral position, a portion of the back of said rotatable seat cradle projects inwardly towards the front of said seat cradle so to lie closer to the front than a portion of said pelvic support bucket which lies below the inwardly projecting back portion of said seat cradle so that said inwardly projecting back portion is configured to engage and press against the lower spine of the user seated in the said seat cradle, wherein, when the rotatable seat cradle is in the neutral position, the front of said seat cradle lies above the bottom of said pelvic support bucket and has a sloping portion that extends upwardly from said intermediate pelvic support bucket, such that the user leaning forward in the seat cradle causes the user's legs to apply a pushing force against the upwardly sloping portion of said front by which to correspondingly cause said seat cradle to rotate in a forward direction and thereby unload the user's upper body weight from his pelvic sacroiliac joints so as to induce pelvic tilt and lumbar lordosis;

a yoke connected between said base and said rotatable seat cradle and comprising a pair of upright struts between which said rotatable seat cradle is held, each of said pair of upright struts having a coupling hole formed therein; and a pair of cradle couplers, wherein each cradle coupler is a part of the rotatable seat cradle, wherein each cradle coupler is located within a respective coupling hole, such that the rotatable seat cradle is connected to the base by the pair of cradle couplers, and not otherwise connected to the base, such that the rotatable seat cradle is suspended above a portion of the base, and wherein said cradle couplers are rotatable within respective ones of said coupling holes to establish pivots at which said seat cradle freely rotates when the user leans forward and back.

14. The combination recited in claim 13, further comprising a coupling sleeve affixed to each of the pair of upright struts of the yoke to lie outside and surround the coupling hole, each cradle coupler being received within the coupling sleeve and extending therefrom for receipt within the coupling hole for rotation within the coupling hole when the rotatable seat cradle rotates.

15. The combination recited in claim 13, wherein each of the pair of upright struts has a cradle support arm extending therefrom in a rearward direction, and wherein the coupling hole formed in each one of the pair of upright struts of the yoke to receive a cradle coupler therewithin is located at the intersection of the one of the pair of upright struts with the cradle support arm and an armrest which extends therefrom.

16. A combination comprising:

a base having a first upright portion with a first coupling hole disposed therein, and a second upright portion with a second coupling hole disposed therein;

a rotatable seat cradle having a back, a bottom, a first side fixedly connected to the back and the bottom, and a second side fixedly connected to the back and the bottom, wherein the rotatable seat cradle has a neutral position in which:

a top portion of the back is positioned forward of a bottom portion of the back, and a rear portion of the bottom is positioned below a forward position of the bottom;

a first cradle coupler that is part of the seat cradle and extends from the first side of the seat cradle, such that the first cradle coupler cannot rotate with respect to the first side; and a second cradle coupler that is part of the seat cradle and extends from the second side of the seat cradle, such that the second cradle coupler cannot rotate with respect to the second side, wherein the first cradle coupler is received in the first coupling hole and the second cradle coupler is received in the second coupling hole, such that the seat cradle is connected to the base by the first cradle coupler and the second cradle coupler, and is not otherwise connected to the base, such that the seat cradle is suspended above a portion of the base, and such that the first and second cradle couplers freely rotate within the first and second coupling holes.

17. The combination recited in claim 16, further comprising a coupling sleeve affixed to each of the first upright portion and the second upright portion to lie outside and surround the coupling hole, each cradle coupler being received within the coupling sleeve and extending therefrom for receipt within the coupling hole for rotation within the coupling hole when the rotatable seat cradle rotates.

18. The combination recited in claim 16, wherein the first coupling hole is located at an intersection of the first upright portion and a first cradle support arm with a first armrest extending therefrom, and wherein the second coupling hole is located at an intersection of the second upright portion and a second cradle support arm with a second armrest extending therefrom.

* * * * *